US006095119A

United States Patent [19]

Maier et al.

[11] Patent Number: 6,095,119

[45] Date of Patent: Aug. 1, 2000

[54] FUEL INJECTION SYSTEM FOR INTERNAL COMBUSTION ENGINES

[75] Inventors: Claus Maier, Ludwigsburg; Stefan Sundermann; Antonio Balboa, both of Stuttgart, all of Germany

[73] Assignee: Robert Bosch GmbH, Stuttgart, Germany

[21] Appl. No.: 09/101,633

[22] PCT Filed: Jul. 2, 1997

[86] PCT No.: PCT/DE97/01383

§ 371 Date: Jul. 14, 1998

§ 102(e) Date: Jul. 14, 1998

[87] PCT Pub. No.: WO98/21469

PCT Pub. Date: May 22, 1998

[30] Foreign Application Priority Data

Nov. 14, 1996 [DE] Germany ..... 196 47 049

[51] Int. Cl.[7] ..... F02M 37/04

[52] U.S. Cl. ..... 123/447; 123/456; 123/468

[58] Field of Search ..... 123/456, 468, 123/469, 447

[56] References Cited

U.S. PATENT DOCUMENTS

| | | | |
|---|---|---|---|
| 5,090,385 | 2/1992 | Usui et al. | 123/456 |
| 5,109,822 | 5/1992 | Martin | 123/456 |
| 5,307,782 | 5/1994 | Davis | 123/447 |
| 5,311,850 | 5/1994 | Martin | 123/456 |
| 5,471,959 | 12/1995 | Sturman | 123/456 |

*Primary Examiner*—Thomas N. Moulis
*Attorney, Agent, or Firm*—Edwin E. Greigg; Ronald E. Greigg

[57] ABSTRACT

A fuel injection system for internal combustion engines having a high-pressure fuel reservoir supplied from a high-pressure fuel pump. The high-pressure fuel reservoir takes the form of a hollow sphere, which is welded together from two forged hollow hemispheres. Fastening elements formed in a forging operation are used to secure the high-pressure fuel reservoir in a vehicle.

3 Claims, 1 Drawing Sheet

FUEL INJECTION SYSTEM FOR INTERNAL COMBUSTION ENGINES

PRIOR ART

The invention is based on a fuel injection system for internal combustion engines. In one such fuel injection system, known for instance from European Patent Disclosure EP 0 507 191, the high-pressure fuel reservoir comprises a prefabricated tube, onto which connection cuffs are thrust, for connecting the fuel injection valves or the high-pressure line arriving from the high-pressure fuel pump. Such a high-pressure fuel reservoir is comparatively bulky and therefore requires a large amount of installation space. Moreover, it is relatively heavy and its hydraulic performance is unfavorable.

ADVANTAGES OF THE INVENTION

By means of the fuel injection system according to the invention, a high-pressure fuel reservoir is now created that requires less installation space, is lower in weight, and whose hydraulic performance is extraordinarily favorable.

BRIEF DESCRIPTION OF THE DRAWING

One exemplary embodiment of the invention is shown in the drawing and described in detail in the ensuing description.

Shown are.

DESCRIPTION OF THE EXEMPLARY EMBODIMENT

Figure 1:
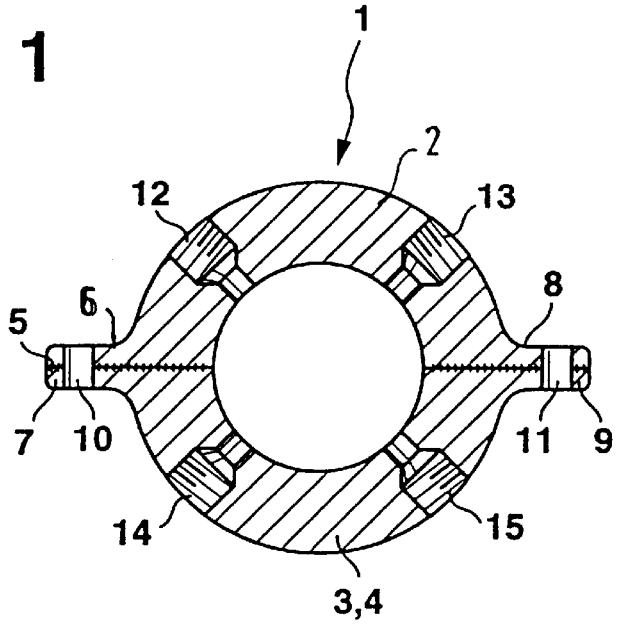
FIG. 1, a section through the spherical high-pressure fuel reservoir with the fastening elements.

A high-pressure fuel reservoir 1 has the form of a hollow sphere 2, which is composed of two hollow hemispheres 3 and 4. Both hemispheres 3 and 4 are produced in a forging operation and subsequently welded together along their annular contacting faces. A weld seam is identified by reference numeral 5. The two hollow hemispheres 3 and 4 may, however, also be screwed together in some way not shown.

The two hollow hemispheres 3 and 4 have eyelet like fastening elements 6, 7, 8 and 9 that correspond with one another and are formed in the forging operation; the fastening elements after the welded are each preferably provided with one through bore 10 and 11, respectively, for fastening screws, not shown, with which the high-pressure fuel reservoir 1 can be secured in a vehicle. As shown in section in FIG. 1, connecting bores 12, 13, 14 and 15 are provided in a plane 4 at right angles to the weld seam 5; they are intended for the connection of lines that are used for connecting the high-pressure fuel reservoir 1 to electrically controlled injection valves. Neither the lines nor the injection valves are shown. The four connecting bores 12–15 are located in pairs diametrically opposite one another and each has a female thread 16 and a smaller-diameter through bore 18, adjoining the female thread 16 via a hollow-conical sealing face 17; the bore 18 communicates with an internal chamber 19 of the reservoir. These features are shown on a larger scale in FIG. 2. The internal chamber 19 of the reservoir has a volume of approximately 33 cm, for instance.

Figure 2:
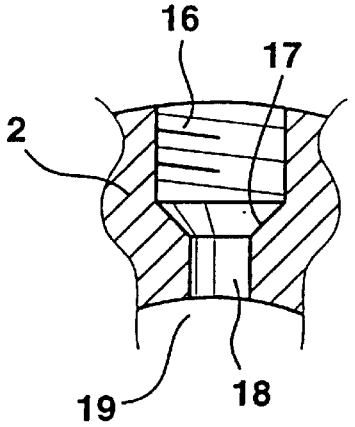
FIG. 2 illustrates a detail of a connection.
Figure 3:
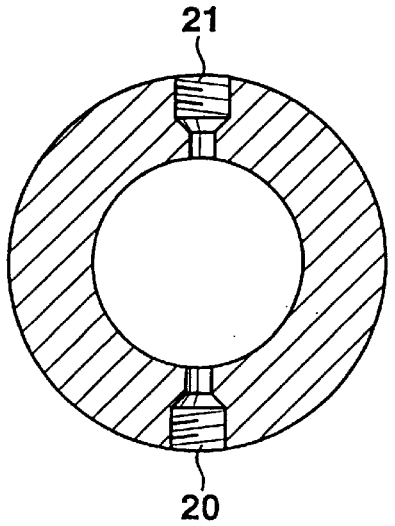
FIG. 3 is a section in a different plane from FIG. 1.

FIG. 3 shows a section through the sphere 2; this section is located in a different plane from the section of FIG. 1. A connecting bore 20 can be seen, to which a pressure inlet from a high-pressure fuel feed pump can be connected. Opposite the connecting bore 20, a further connecting bore 21 is provided, into which a pressure sensor or a control valve can be secured.

The two connecting bores 20 and 21 are also provided with a female thread 16, a sealing face 17, and a through bore 18. In all the connecting bores 12–15 and 20 and 21, high-pressure lines can be inserted tightly and firmly in a manner not shown, and these high-pressure lines then communicate with the internal chamber 19 of the reservoir via the through bores 18.

The foregoing relates to preferred exemplary embodiments of the invention, it being understood that other variants and embodiments thereof are possible within the spirit and scope of the invention, the latter being defined by the appended claims.

We claim:

1. A fuel injection system for internal combustion engines, comprising a high-pressure fuel pump which supplies a high-pressure fuel reservoir (1) with fuel, from said reservoir the fuel is delivered to electrically controlled injection valves for injection into the combustion chambers of a self-igniting internal combustion engine, wherein the high-pressure fuel reservoir (1) is provided with connecting bores (12, 13, 14, 15) for fuel delivery and fuel removal and with fastening elements (6, 7, 8, 9), and said high-pressure fuel reservoir (1) has the form of a hollow sphere (2).

2. The fuel injection system according to claim 1, in which the hollow-spherical high-pressure fuel reservoir (1) is produced from two forged hollow hemispheres (3 and 4).

3. The fuel injection system according to claim 2, in which the two hollow hemispheres (3 and 4) are joined together at annular contacting faces by means of a weld seam (5).

* * * * *